US005247766A

United States Patent [19]

Kildea

[11] Patent Number: 5,247,766

[45] Date of Patent: Sep. 28, 1993

[54] PROCESS FOR IMPROVING COOLING HOLE FLOW CONTROL

[76] Inventor: Robert J. Kildea, 2063 Ascott Cir., N. Palm Beach, Fla. 33408

[21] Appl. No.: 829,148

[22] Filed: Jan. 31, 1992

[51] Int. Cl.[5] ..... B24C 1/00; B24C 7/00

[52] U.S. Cl. ..... 51/317; 51/328; 51/281 R

[58] Field of Search ..... 51/317, 318, 323, 326, 51/165.71, 165.74

[56] References Cited

U.S. PATENT DOCUMENTS

| | | | |
|---|---|---|---|
| 3,583,103 | 6/1971 | Rystrom | 51/7 |
| 4,005,549 | 2/1977 | Perry | 51/317 |
| 4,087,943 | 5/1978 | Perry | 51/317 |
| 4,376,004 | 3/1983 | Bratton et al. | 156/89 |
| 4,420,957 | 12/1983 | Weber | 51/410 |
| 4,827,587 | 5/1989 | Hall et al. | 29/156.8 B |
| 4,883,404 | 11/1989 | Sherman | 415/115 |
| 4,936,057 | 6/1990 | Rhoades | 51/317 |
| 4,946,092 | 8/1990 | Van Poorten | 51/317 |
| 5,054,247 | 10/1991 | Rhoades et al. | 51/317 |
| 5,070,652 | 12/1991 | Rhoades et al. | 51/317 |

*Primary Examiner*—Bruce M. Kisliuk
*Assistant Examiner*—Bryan Reichenbach

[57] ABSTRACT

Undersized cooling holes for air cooling a gas turbine component or the like, are formed at low cost, and are later enlarged to increase the flow rate of cooling air therethrough by blowing a mixture of abrasive grit through the holes to enlarge them. Air without the grit is thereafter passed through the holes and the resulting increased flow rate is measured to see if it is at a satisfactory level. If it is not, the process is repeated until the desired accurate flow rate is achieved.

1 Claim, 1 Drawing Sheet

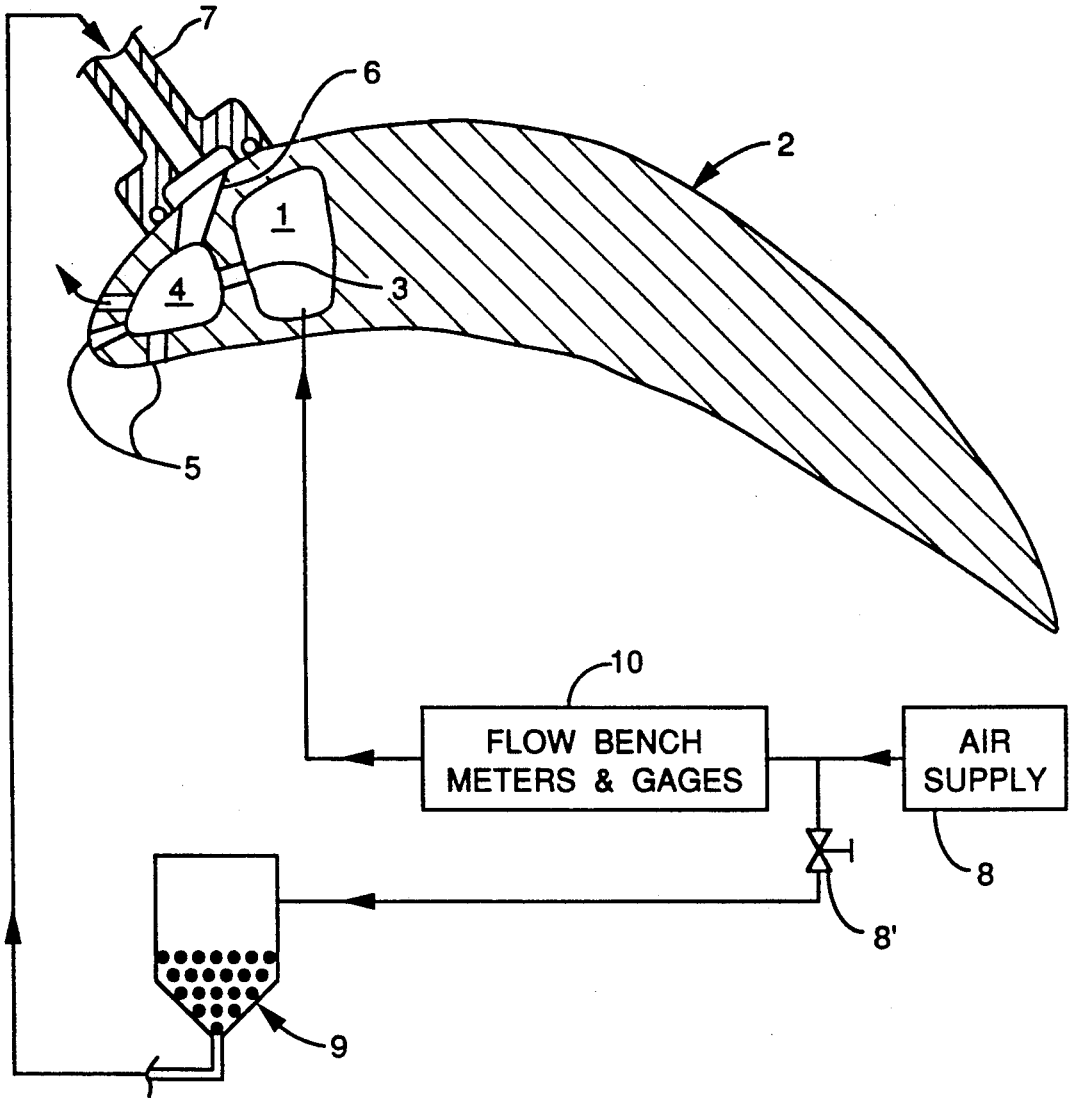
7
6
2
1
4
3
5
10
FLOW BENCH
METERS & GAGES
AIR
SUPPLY
8
8'
9

PROCESS FOR IMPROVING COOLING HOLE FLOW CONTROL

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of cooling turbine components such as vanes or blades.

Gas turbine components such as vanes and blades, often in the form of airfoils, are cooled by passing pressurized cooling air through holes in the airfoils and then over the surfaces thereof. Clusters of cooling air holes (shower head holes) require accurate flow rate control so that cooling air is not wasted where the holes are too big or insufficient cooling air is supplied where the holes are too small, which could result in the ingestion of hot gas path air. Unfortunately, low cost methods for producing the holes such as laser drilling, generally yield poor flow rate control of the cooling air passed through the holes.

BRIEF SUMMARY OF THE INVENTION

It is thus an object of the invention to provide a method of reducing the cost of producing accurate cooling holes in gas turbine components and the like by providing undersized holes which are inexpensive to produce, and thereafter gradually enlarging the holes by propelling abrasive grit particles through the holes for a given time period to enlarge the holes and to thereafter measure the resulting increased flow rate of air passed through the now enlarged holes at a given pressure head. If the flow rate is still less than the desired flow rate the above steps are repeated to further enlarge the holes until the desired flow rate through the holes is attained. Thus the method can accurately control the final flow rate of cooling air in a highly controlled and yet economical manner, since the originally drilled holes are inexpensive to produce.

BRIEF DESCRIPTION OF THE DRAWING

Other objects, features and advantages of the invention will become apparent upon study of the following description, taken in conjunction with the sole FIGURE, which is a partial sectional view of an airfoil and related components for carrying out the method of the invention.

DETAILED DESCRIPTION OF AN EMBODIMENT OF THE INVENTION

In order to measure the flow rate of cooling air through the cooling holes 5 for a given pressure head differential, air supply means 8 causes pressurized air to flow into the airfoil supply cavity 1 within turbine component 2 via a conventional flow bench 10 with its meters and gages. The air thereafter passes through an internal metering hole 3 and into a second cavity 4, and through the cooling air holes 5, which are being flow checked, and is discharged into the atmosphere. The air flow rates are controlled and measured upstream by the conventional valves and flow gages on the flow bench 10.

Other holes in cavity 1 or 4, not shown, are normally taped shut. However, hole 6 is covered by a sealed cover 7 which is connected to a supply of fine abrasive grit 9, the particles thereof being considerably smaller than either holes 5 or 6. During the checking of the cooling air flow rate mentioned above, no grit is supplied to sealed cover 7 because valve 8 in the pressurized air supply line to the grit hopper 9 is closed. Air flow is now measured by a flow gage on the flow bench. If the flow rate check indicates that the flow rate is less than the desired flow rate, valve 8 is cracked and the grit hopper 9 is thus pressurized slightly above the pressure inside cover 7, so that grit carried by the pressurized air propellant will flow at low velocity through hole 6 and into chamber 4 where it is accelerated to a high velocity as it is propelled by air flowing from the flow bench 10 through the holes 5 to be enlarged.

After a given period, the valve 8 is again closed and the now somewhat increased flow rate, due to further enlarging of the holes, is again measured. If it is sufficiently high, the process is complete. If it is still lower than desired, the valve 8 is again opened to cause further enlarging of the cooling holes by the action of the high velocity abrasive grit striking the holes. The pressure of the air introduced into cavity 1 is not particularly critical; it should be sufficiently high to produce a grit particle velocity sufficient to enlarge the cooling holes within a relatively short (reasonable) time period.

Further advantages of the present invention are as follows. The process can be automated so that a burst of grit is released proportional to the measured flow rate and then the flow check is repeated. The less costly process can be repeated automatically so as to achieve greater flow control accuracy than accuracy that is possible through the use of more costly drilling methods.

Also, the action of the abrasive grit will improve the quality of the subsequent cooling air flow since much of the flow increase will come from radiusing inner edge portions of the holes. The grit will not have a detrimental effect on other holes such as 6 since the grit is introduced therein at low velocity. Additionally, should any debris be present in the holes due to the laser drilling of the undersized holes, such debris will be swept away by the pressurized air introduced into cavity 1.

While there has been described what is at present considered to be the preferred embodiments of this invention, it will be obvious to those skilled in the art that various changes and modifications may be made therein without departing from the invention and it is, therefore, intended in the appended claims to cover all such changes and modifications as fall within the true spirit and scope of the invention, including art recognized equivalents.

What is claimed is:

1. Method of producing accurate fluid conducting holes in a member comprising the steps of:

(a) providing said member having a plurality of said fluid conducting holes which are undersized and thus will have a fluid flow rate therethrough, for a given pressure head, which flow rate is less than a desired flow rate, said member having an interior cavity adjacent said plurality of holes;

(b) providing a single source of pressurized air for continually directing pressurized air into said interior cavity via a flow rate meter;

(c) providing a powdered abrasive storage means and a valve, both being serially coupled between said single source of pressurized air and said interior cavity;

(d) opening said valve to cause the powdered abrasive within said storage means to be propelled into said interior cavity by said pressurized air from said single source;

(e) thereafter closing said valve and measuring the flow rate of pressurized air from said single source passing through said holes; and (f) thereafter repeating steps (d) and (e) until the desired flow rate is obtained.

* * * * *